United States Patent [19]

Beaulieu

[11] 3,965,584

[45] June 29, 1976

[54] FOOTWEAR AND ATTACHMENT ASSEMBLY FOR SNOWSHOEING

[76] Inventor: Maurice Beaulieu, 120 Dequoy St., St. Gabriel de Brandon, Quebec, Canada

[22] Filed: Dec. 9, 1974

[21] Appl. No.: 531,194

[52] U.S. Cl. ..... 36/122
[51] Int. Cl.[2] ..... A43B 00/00
[58] Field of Search ..... 36/2.5 R, 2.5 AB, 50

[56] References Cited

UNITED STATES PATENTS

| | | | |
|---|---|---|---|
| 1,236,925 | 8/1917 | Gordon | 36/2.5 AB |
| 3,000,117 | 9/1961 | Howe | 36/2.5 AB |

*Primary Examiner*—Patrick D. Lawson

[57] ABSTRACT

A footwear, in particular a mocassin, provided with an attachment to prevent longitudinal and transverse relative displacement between the snowshoe and the footwear and to provide simple and rapid attachment of the latter to the snowshoe. A footwear or moccasin including a strap secured against the exterior face of each of the two opposite lateral walls of the front portion of the footwear, and forming upright strap passages against the opposite sides of the footwear and in transverse alignment with the articulation of the toes, and tying straps projecting through the upright strap passages and attaching a snowshoe to the footwear.

6 Claims, 6 Drawing Figures

FIG. 5
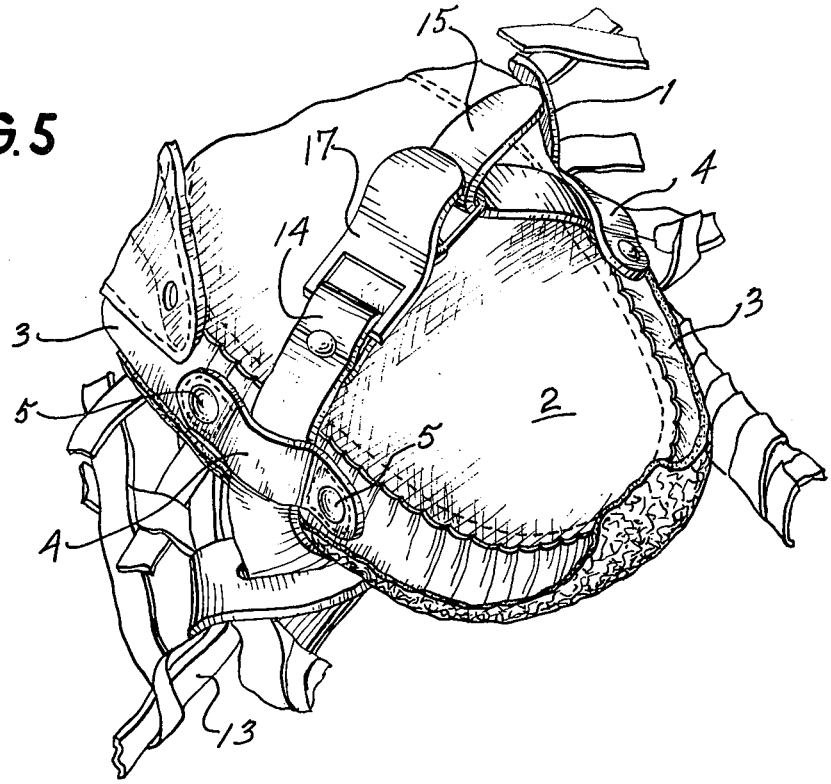
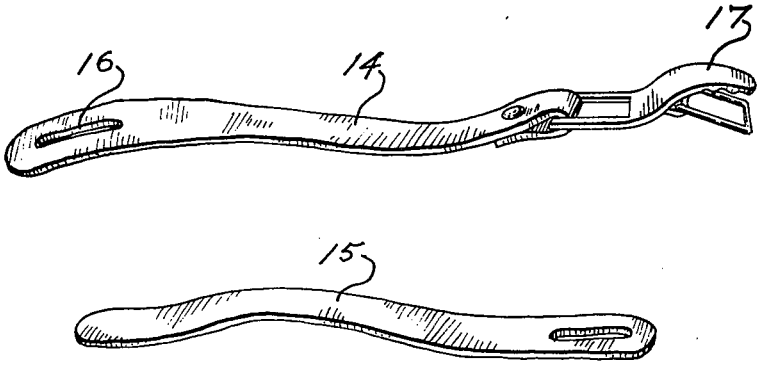
FIG. 6

FOOTWEAR AND ATTACHMENT ASSEMBLY FOR SNOWSHOEING

This invention relates to footwear and, more particularly, to a moccasin, boot, or the like adapted for attachment to a snowshoe.

Up to now there have been proposed different harnesses aimed as securely attaching a snowshoe to a moccasin or the like footwear and thus facilitate the co-operation between the latter and an associated snowshoe. However, difficulties still impede suitable attachment to prevent longitudinal and transverse relative displacements between the snowshoe and the footwear, such as a moccasin. The longitudinal displacement, for instance, may result in engagement of the toe portion of the moccasin with the transverse front bar of the snowshoe, thus hindering normal snowshoeing.

It is a general object of the present invention to provide a footwear, such as a moccasin, with an attachment for tying to a snowshoe, preventing longitudinal and transverse relative displacement between the snowshoe and the footwear, avoiding complex harnesses and hindering the flexion of the toes, and allowing easy and rapid attachment to a snowshoe.

The above and other objects and advantages of the present invention may be better understood in the light of the following detailed description of preferred embodiments thereof, which are illustrated, by way of example, in the accompanying drawings, wherein:

FIG. 5 is a perspective view of the front portion of a moccasin operatively attached to an underlying snowshoe, according to a second embodiment of the invention; and FIG. 6 is a perspective view of the two tying straps forming part of the embodiment of FIG. 5.

Figure 1:
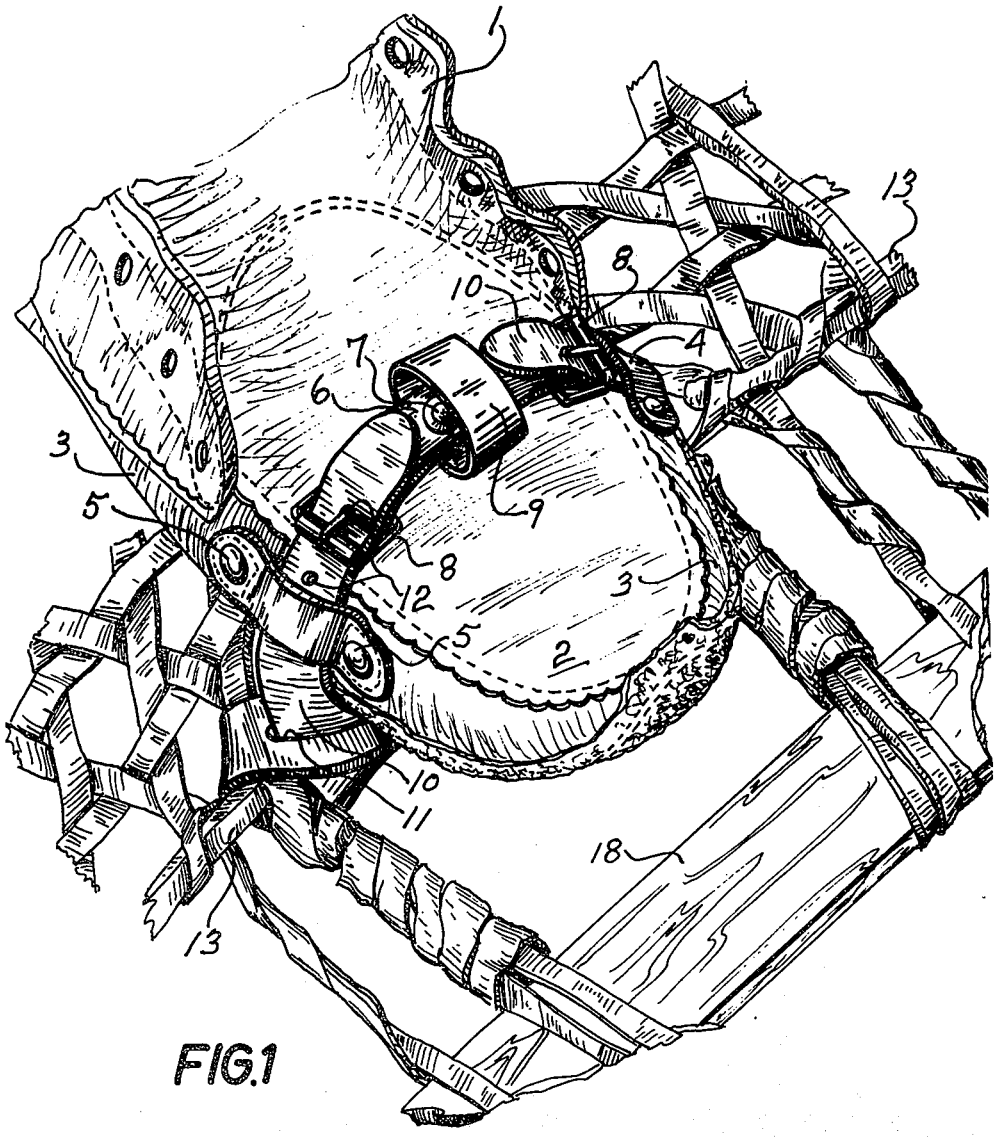
FIG. 1 is a cross-sectional view of the front end portion of a moccasin operatively attached to an underlying snowshoe, according to a first embodiment of the present invention.
Figure 2:
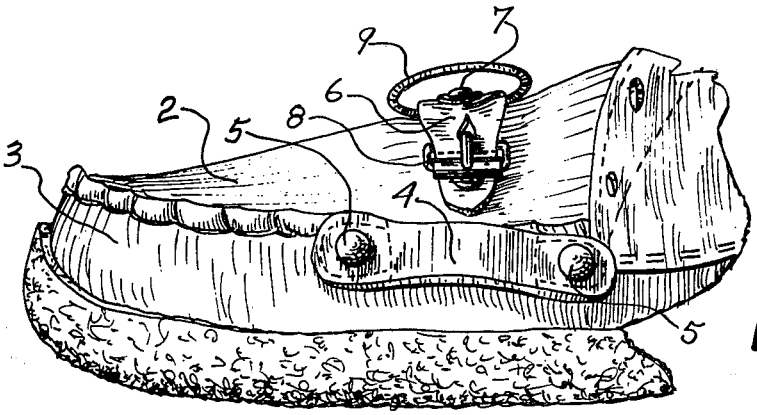
FIG. 2 is a side view of the front end portion of a moccasin.

The moccasin 1 according to each of the two illustrated embodiments has a front portion including a top 2 and a pair of opposite side walls 3. A strap 4 is fixed against the outer face of each side wall 3 to extend longitudinally of the moccasin 1. A rivet 5 secures each end of each strap 4 to the moccasin, such as to form an intermediate portion of these straps which is loose and forms an upright strap passage against the corresponding sidewall 3. Obviously, other suitable expedients can replace the rivets 5, such as sewing of each end of the straps 4.

Reference should now be made to FIGS. 1 to 4 inclusive for particular description of the first embodiment illustrated therein. An intermediate strap 6 is secured at its mid-portion to the top 2 of the moccasin, by a rivet 7, such that this intermediate strap extends transversely of the moccasin. A buckle 8 is secured at each end of the intermediate strap 6. A guiding loop 9 is secured to the top 2, also by the rivet 7, to form a transverse passage to secure the end of a strap.

Figure 3:
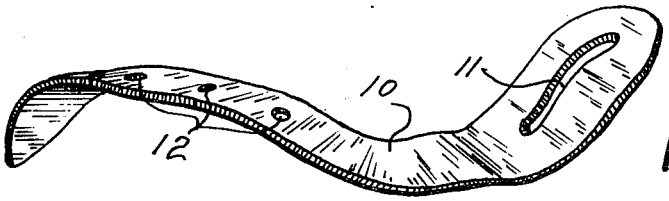
FIG. 3 is a perspective view of a tying strap according to the first embodiment of the invention illustrated in FIGS. 1 and 2.
Figure 4:
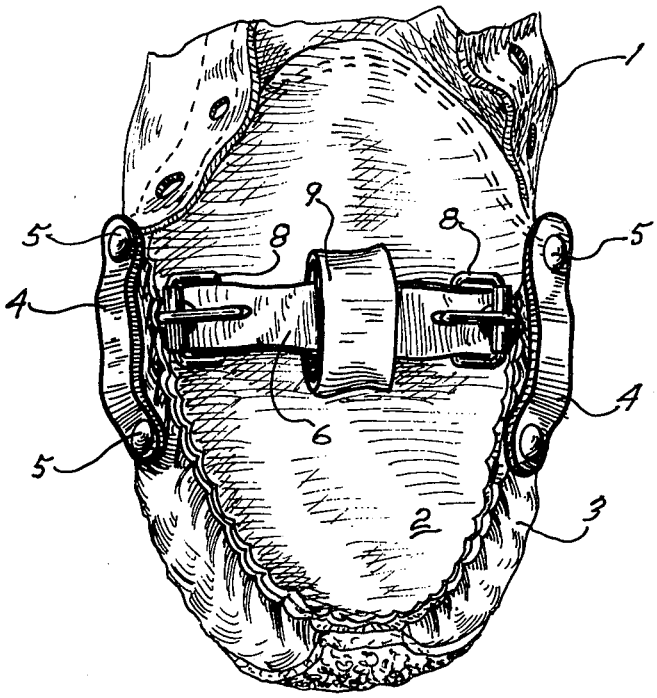
FIG. 4 is a top view of the front portion of a moccasin provided with attachment for snowshoeing according to the first embodiment of the present invention.

A pair of tying straps 10, shown in FIGS. 1 and 3, have each one end provided with a slot 11 and the opposite end provided with holes 12 and forming a tongue for securement into one buckle 8. According to this first embodiment, each strap 10 is secured to a transverse thong 13 by looping around the latter and insertion of the corresponding tongue through the slot 11. Thereafter, the underlying snowshoe is secured to the moccasin 1 by passing the tongue of each tying strap 10 into the corresponding upright strap passage formed by a strap 4 and by securing the same to one of the buckles 8 of the intermediate strap 6.

Reference should now be made to FIGS. 5 and 6 for particular description of the second embodiment of the invention which includes a pair of tying straps 14 and 15, each having a slot 16 at one end thereof for securement as the straps 10 to a transverse thong 13. The other end of the tying strap 14 has an automatic catching buckle 17 and the other end of the tying strap 15 froms a tongue engageable into the buckle 17.

The tying straps 10, 14, and 15, by engagement into the aforementioned upright strap passsages formed by the straps 4, cause longitudinal fixing of the moccasin or other footwear relative to the snowshoes and prevent engagement of the toe portion of the moccasins with the transverse bar 18 of the snowshoe.

What I claim is:

1. A footwear and attachment assembly for snowshoeing comprising a footwear including a front foot portion having a pair of lateral walls, a pair of strap portions secured against the outer face of said lateral walls respectively, projecting lengthwise of said footwear transversely adjacent the articulation of the toes, and having an intermediate loose portion forming an upright passage, and a pair of tying straps insertable through said upright passages respectively, securable to each other over said front foot portion at said articulation, and each having a bottom end securable to an underlying snowshoe.

2. A footwear and attachment assembly as defined in claim 1, wherein each of said tying straps has a slot of predetermined size in the bottom end thereof for insertion of said tying strap therethrough after looping around a thong of said underlying snowshoe.

3. A footwear and attachment assembly as defined in claim 2, wherein one of said tying straps has a buckle attached at the other end thereof and the other of said tying straps has a tongue portion at the other end thereof releasably securable into said buckle over said front end portion of said footwear.

4. A footwear and attachment assembly as defined in claim 3, wherein said buckle is of the automatic catching type.

5. A footwear and attachment assembly for snowshoeing, comprising a footwear including a front foot portion having a pair of lateral walls, a pair of strap portions secured against the outer face of said lateral walls respectively, projecting lengthwise of said footwear transversely adjacent the articulation of the toes, and having an intermediate loose portion forming an upright passage, a pair of tying straps insertable through said upright passages respectively, securable to each other over said front foot portion at said articulation, and each having a bottom end securable to an underlying snowshoe, and an intermediate strap extending transversely of said footwear, connected means securing the intermediate strap onto the top of said front foot portion, and a buckling means at each end of said intermediate strap and adapted for buckling thereof with the other end of one of said tying straps.

6. A footwear and attachment assembly as defined in claim 5, wherein said connecting means includes a rivet securing the midportion of said intermediate strap to said top of said front end portion and each of said buckling means includes a buckle and said other end of each of said tying straps constitutes a tongue catchingly engaging said buckle of the corresponding end of said intermediate strap.

* * * * *